US009892639B2

(12) United States Patent
Ullrich et al.

(10) Patent No.: US 9,892,639 B2
(45) Date of Patent: Feb. 13, 2018

(54) EMISSIONS REDUCTION IN VEHICLE PARKING

(71) Applicants: Oliver Ullrich, Miami Beach, FL (US); Naphtali David Rishe, Miami Beach, FL (US)

(72) Inventors: Oliver Ullrich, Miami Beach, FL (US); Naphtali David Rishe, Miami Beach, FL (US)

(73) Assignee: The Florida International University Board of Trustees, Miami, FL (US)

( * ) Notice: Subject to any disclaimer, the term of this patent is extended or adjusted under 35 U.S.C. 154(b) by 416 days.

(21) Appl. No.: 14/660,283

(22) Filed: Mar. 17, 2015

(65) Prior Publication Data

US 2016/0253847 A1 Sep. 1, 2016

Related U.S. Application Data

(60) Provisional application No. 62/126,033, filed on Feb. 27, 2015.

(51) Int. Cl.

| | |
|---|---|
| ***G08G 1/065*** | (2006.01) |
| ***G08G 1/14*** | (2006.01) |
| ***G07B 15/02*** | (2011.01) |

(52) U.S. Cl.

CPC ..... *G08G 1/065* (2013.01); *G07B 15/02* (2013.01); *G08G 1/143* (2013.01)

(58) Field of Classification Search

None

See application file for complete search history.

(56) References Cited

U.S. PATENT DOCUMENTS

| | | | | |
|---|---|---|---|---|
| 5,745,052 A * | 4/1998 | Matsuyama | ..... | G07B 15/04 235/375 |
| 6,525,673 B1 * | 2/2003 | Feldman | ..... | G08G 1/015 235/384 |
| 2013/0132102 A1 * | 5/2013 | Andrade | ..... | G06Q 50/30 705/1.1 |
| 2015/0130641 A1 * | 5/2015 | Rahman | ..... | G08G 1/142 340/932.2 |

* cited by examiner

*Primary Examiner* — Kevin H Flynn
*Assistant Examiner* — Emmett K. Walsh
(74) *Attorney, Agent, or Firm* — Saliwanchik, Lloyd & Eisenschenk

(57) ABSTRACT

Given a parking structure where vehicle identification devices are placed so that they can identify the entry and exit of individual vehicles, techniques and systems recommend a parking zone with available spaces to a driver based on likely desirability, which may reduce vehicle emissions associated with cruising for a parking space. Techniques include determining a zone recommendation by selecting the zone having the highest attractiveness value and an occupancy ratio lower than a threshold, and modifying parking metrics in accordance with the probability that the driver will follow the recommendation. Vehicle metadata may be used as a factor in the zone recommendation. Information about actual driver parking behavior and/or an analysis of historical parking records may be used to adjust system parameters, including the probability the driver will follow the recommendation and the attractiveness values.

10 Claims, 4 Drawing Sheets

EMISSIONS REDUCTION IN VEHICLE PARKING

CROSS-REFERENCE TO A RELATED APPLICATION

This application claims the benefit of U.S. Provisional Application Ser. No. 62/126,033, filed Feb. 27, 2015 which is hereby incorporated by reference in its entirety, including any figures, tables, or drawings.

GOVERNMENT SUPPORT

This invention was made with government support under grant number U.S. Pat. No. 1,213,026 awarded by the National Science Foundation. The government has certain rights in the invention.

BACKGROUND

Over time, commercial and business centers have grown more densely populated, cars more numerous, and the value of real estate has risen. In response, parking structures have grown larger, and finding a parking space in large parking structures has become difficult and time-consuming for drivers. Furthermore, the act of circling or cruising around a large parking structure can create vehicle emissions that can negatively impact air quality, particularly inside semi-enclosed parking structures. At the same time, license plate readers (LPR) have been installed on the entrances and exits of many parking structures in order to improve security and parking compliance.

BRIEF SUMMARY

Techniques and systems are disclosed for reducing vehicle emissions associated with cruising for a parking space in a parking structure. Given a parking structure where vehicle identification devices (such as LPRs) are placed so that they can identify the entry and exit of individual vehicles, techniques and systems can recommend a parking zone with available spaces to a driver based on likely desirability. These technical features can increase the likelihood that a driver will find a desirable space without excessive cruising, which in turn has the technical effect of reducing vehicle emissions and improving air quality, particularly in semi-enclosed spaces.

In some implementations, the system may interact with certain other components to improve the system's accuracy. Certain other components can provide feedback to the system about the driver's chosen (actual) parking zone, which can then be used to assess whether the driver followed the recommendation. Updated feedback can be used to update parking zone occupancy statistics for the parking structure, improving recommendation accuracy, and in some cases may be used to tune system assumptions (e.g., parameter values) with respect to all drivers, individual drivers, or groups of drivers.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION

Figure 1:
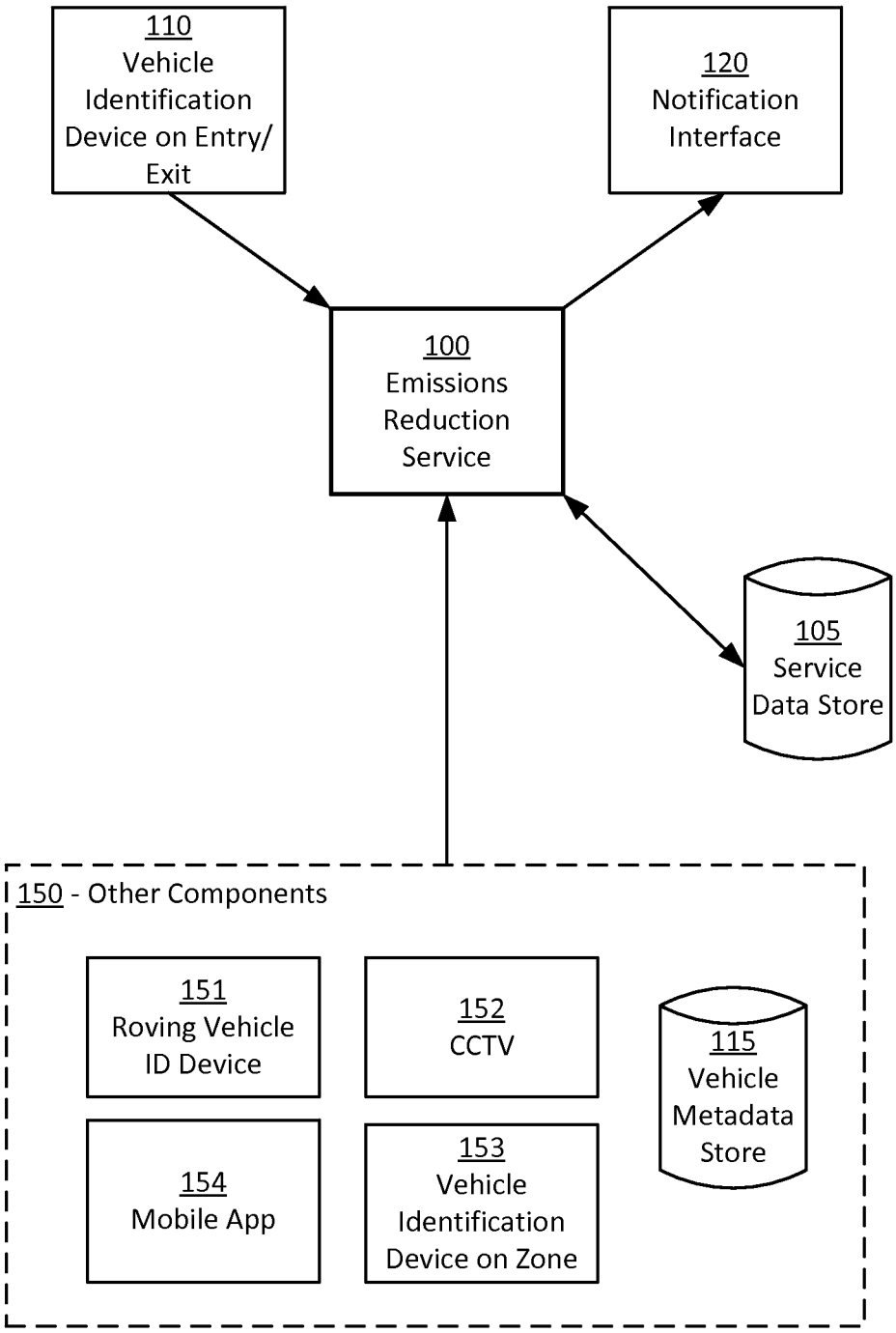
FIG. 1 shows an example component environment for reducing vehicle emissions in a parking structure.

Techniques and systems are disclosed for reducing vehicle emissions associated with cruising for a parking space in a parking structure. Given a parking structure where vehicle identification devices (such as LPRs) are placed so that they can identify the entry and exit of individual vehicles, techniques and systems can recommend a parking zone with available spaces to a driver based on likely desirability. These technical features can increase the likelihood that a driver will find a desirable space without excessive cruising, which in turn has the technical effect of reducing vehicle emissions and improving air quality, particularly in semi-enclosed spaces.

Techniques and systems can enable these advantages without the additional expense of individual parking space occupancy sensors. Some parking garages may equip each individual parking space with an LPR or other sensor device (e.g., a transponder, magnetometer, Bluetooth, or RFID device), in which case it is possible to instantly check the availability of each spot and determine the identity of the occupant. However, equipping each individual parking space with a sensor device can be prohibitively expensive for large lots and require extensive retrofitting. Furthermore, even a system with very accurate occupancy statistics may require an understanding of driver preferences in order to reduce vehicle emissions.

Techniques and systems herein may in some implementations discern driver behaviors to find a highly targeted recommendation, advantageously reducing vehicle emissions by directing a driver to a desirable available space without roaming. Reduced roaming may even result in downstream benefits in vehicles without emissions (e.g., electric vehicles), since even battery operated vehicles have a power generation cost and impact, such as power generation plant emissions and the environmental impact of rechargeable batteries. Additional effects of the disclosed technical features include increased driver satisfaction and a lower cost than systems requiring a sensor device on every parking space.

A parking structure can include, for example, a parking garage, multi-story parking garage, parking lot, permit-restricted street, or other places where vehicles can park. Techniques are applicable to a wide range of shapes and configurations of parking structure, so long as the parking structure can be segmented into parking zones with varying degrees of attractiveness, and so long as a way of determining when vehicles enter and exit the parking structure is available.

In some implementations, the system may interact with certain other components to improve the system's accuracy. Certain other components can provide feedback to the system about the driver's chosen (actual) parking zone, which can then be used to assess whether the driver followed the recommendation. Updated feedback can be used to update parking zone occupancy statistics for the parking structure, improving recommendation accuracy, and in some cases may be used to tune system assumptions (e.g., parameter values) with respect to all drivers, individual drivers, or groups of drivers.

In some implementations, recommendations may be tailored to drivers based on known preferences or classes/categories of driver. For example, certain drivers may be restricted or empowered to park in a certain zone (e.g., faculty or students at a university often must park in designated-colored zones). In another example, members of a certain department may prefer to park nearer a particular door on the south side of the building, rather than the north side. The class/category of a driver may be determinable via a vehicle identification service, which can match particular vehicles to particular driver metadata. At a large university, for example, the vehicle tag identifies a registered driver who has purchased a parking decal or permit, and information about the registered driver (e.g., faculty, staff, student, department, etc.) can be obtained and correlated to a likely parking preference.

In some implementations, additional technologies or methods may be used to improve the accuracy of occupancy statistics and the accuracy of recommendations system-wide, to groups of drivers, or to individual drivers. For example, a roving vehicle identification device may identify vehicles after the vehicles are parked in order to assess whether the system's recommendations were followed. In some implementations, systems and techniques may communicate with a mobile device application service that drivers can use to record the location of their parking space each day. In some implementations, images from a closed circuit television camera may be extracted to determine the final parking location of a vehicle. In some implementations, for example in environments where the entrance and exit of individual parking zones (e.g., each level of a multistory parking structure) have additional counters or vehicle identification devices, this information may be used assess whether the system's recommendation to the driver was followed.

FIG. 1 shows an example component environment for reducing vehicle emissions in a parking structure. In FIG. 1, emissions reduction service 100 implements certain techniques in coordination with other system components. Emissions reduction service 100 may implement techniques as described with respect to process flows detailed in FIGS. 2A-2C and 3, as well as other process flows.

Emissions reduction service 100 may utilize or interact with a service data store 105 that stores a variety of information relating to the operations of the emissions reduction service 100. Emissions reduction service 100 may read information persisted on the data store 105 and update information on the data store to update the state of the system. For example, service data store 105 may store configuration information, parameter values, records of vehicles entering and exiting the parking structure, parking zone utilization data, historical data, and vehicle profile data. These examples are not intended to limit the amount or varieties of data that may be stored by the service data store 105. Service data store 105 may be implemented as databases, tables, and records in a database management system or relational database management system, examples of which are Microsoft SQL Server® and Oracle®. Service data store 105 may also be implemented using NoSQL techniques, XML file structures, or other file structures, as will be appreciated by practitioners in the art.

In certain implementations, the emissions reduction service 100 interacts with one or more vehicle identification devices 110 that may be installed at the entry and exit points of the parking structure. Vehicle identification devices 110 are capable of determining the identity of an entering vehicle so that the vehicle can be recorded as having entered the parking structure and, when the vehicle exits, it can be recorded as having left the parking structure. Vehicle identification devices 110 allow the emissions reduction service 100 to track the identity of entering and leaving vehicles, so that the occupancy of parking zones in the parking structure may be recorded and tabulated.

Vehicle identification devices 110 and systems operative in an emissions reduction system can take a variety of forms, so long as they are capable of identifying a vehicle uniquely with an acceptable margin of error. A non-limiting example is a license plate reader (LPR)/license plate inventory (LPI) system, which uses cameras that zoom in on a vehicle's license plate, take an image, and then use optical character recognition technologies to identify the alphanumeric characters on the license plate and the state of origin. Such systems are used frequently in parking garages, toll booths, on traffic light cameras, and for law enforcement purposes.

Another example is a vehicle identification device 110 that is capable of reading a vehicle parking permit installed on the vehicle via, e.g., a mirror hang-tag, sticker, or transponder. Parking permits are frequently issued to frequent or recurrent patrons of a restricted-use parking structure, such as operated by a university or business. Vehicle identification device 110 that can read a permit can be, for example, optical or detect a radio signal (e.g., RFID) from a tag or transponder.

Another example uses closed-circuit TV to record images of vehicles entering and exiting the parking structure. Image recognition software may be used to identify specific vehicles based on color, shape, or other identifying features.

Generally, emissions reduction service 100 implements techniques in order to provide drivers with targeted, accurate recommendations so that drivers do not cruise or roam the garage, needlessly creating excess vehicle emissions. Emissions reduction service 100 receives input from vehicle identification devices 110, communicates with notification interface 120 devices that display notifications to drivers, reads/stores information in the service data store 105, and in some cases interfaces with other components 150 to refine recommendations. These techniques will be described more fully with respect to the process flows in FIGS. 2A-2C.

After determining a recommendation, emissions reduction service 100 can display the recommendation on an available notification interface 120. A notification interface 120 could be a dynamic sign, such as an LCD or LED sign visible to the driver from the entry point. A notification interface 120 could also be a mobile device application, such as might be operative on an Android® or iOS® device. The mobile device application might be provided by a third party (e.g., the "ParkMe" app from ParkMe, Inc.) and be accessible to the emissions reduction service 100 via an application programming interface (API). In some cases, the mobile device application might be developed in conjunction with the emissions reduction service 100 and made available to interested parking patrons. In some cases, a frequent patron may provide his or her mobile number so that the emissions reduction service 100 may send the notification with an SMS message viewable on the patron's mobile phone, which then becomes the notification interface 120. Naturally, a recommendation could be issued to multiple notification interfaces, in cases where multiple interfaces are available to the driver.

In some implementations, other components 150 may be available to the system to provide additional driver/vehicle information, and/or additional data about driver behavior that can be used to tune the system's parameters to improve recommendation accuracy. Other components 150 can include one or more "parking survey device" (e.g., 151, 152, 153 and 154) that can provide updated information about the post-recommendation behaviors of drivers, as well as additional vehicle metadata stores 115 that provide information that may be pertinent to understanding the behaviors or desires of frequent patrons.

In some cases, a parking structure might employ roving vehicle identification devices 151, often LPR readers mounted on a truck, used to check the validity of decals and license plates for the vehicles that are parked in a parking garage. These readers give detailed feedback on both whether the recommendation given to a specific driver was followed and whether the current emissions reduction service 100 occupancy statistics are accurate.

In some cases, certain areas of a parking structure might be surveyed by closed-circuit television (CCTV) 152. The CCTV 152 cameras may have image recognition software applied to the image streams, and image recognition results may be communicated to the emissions reduction service 100 for further evaluation. If CCTV 152 coverage is comprehensive throughout the garage, detailed feedback may be available (similarly to roving vehicle ID devices) on both whether the recommendation given to a specific driver was followed and whether the current emissions reduction service 100 occupancy statistics are accurate. If CCTV 152 coverage is not complete throughout the garage, the information gained might be partial but still useful. For example, if the recommendation to the driver was to park on "Level 2A" but a CCTV 152 camera detects the vehicle driving around on "Level 3D," then the emissions reduction service 100 knows the recommendation was not followed, even if the driver's ultimate parking selection is unknown.

In some implementations, vehicle identification devices may be present on zone entry and/or exit points 153. These may take the form of LPR readers, positioned, for example, at turns or lift rails in the parking structure. As noted with respect to CCTV coverage, if zone entry/exit points are completely covered, then information about occupancy and driver behaviors may be highly detailed and accurate. In some cases, a vehicle identification device on a zone 153 may serve only to count vehicles, not to identify the vehicles, and thus may provide useful information about current occupancy statistics but little information about individual driver behaviors.

In some implementations, a driver may use a mobile device application 154 that emissions reduction service 100 can interface with to receive very accurate information about occupancy and driver behavior. The mobile app 154 can provide an interface that allows a driver to note where the driver parked, usually with a simple gesture. The mobile app 154 can then lead the driver back to the parking place later on. These features can be, but are not necessarily, part of the same mobile application or suite of applications that served as the notification interface 120 for the driver recommendation. When a driver uses a mobile app to record his or her parking space, and when the emissions reduction service 100 is capable of interchanging data with the mobile app 154, targeted driver behavior with respect to the recommendation, as well as detailed occupancy data, can be obtained and assessed.

In some implementations, a vehicle metadata store 115 is accessible to the emissions reduction service 100. A vehicle metadata store 115 can contain additional information about the driver or the vehicle that can be useful in improving recommendation accuracy. For example, in some cases drivers are required or permitted to have parking permits that take the form, e.g., of decals, mirror hang-tags, or transponders that identify them for entry into a parking structure. These kinds of permits might be issued to employees of a company, university, or be purchased by individuals who live/work in a busy downtown area. In some cases, the permits define parking zones that are restricted or permitted within the parking structure (e.g., a holder of an ORANGE tag may park in ORANGE and GREEN but not BLUE). In some cases, the permits are uniquely identified so that they can be associated with records in a data store specific to a driver or vehicle. The records in the data store may contain metadata (such as the driver's company and/or department, business and/or home address, etc.) that might be useful to determining individual or group driver behaviors, and thus improving vehicle recommendations. In some cases, a vehicle identification device 110 may be part of a vehicle identification system with an associated database containing driver or vehicle metadata.

Whichever of one or more parking survey devices are used (e.g., roving vehicle identification devices 151, CCTV 152, vehicle identification devices on zones 153, and mobile device applications 154), emissions reduction service 100 can use information about where a driver actually parked and compare the actual parking zone to the recommended zone. The emissions reduction service 100 can use the information to improve the accuracy of its occupancy ratios at a given time. It may also use the information to refine or adjust occupancy thresholds, probability variables, or parameter values for the system, for groups, and for individual drivers. Furthermore, over time, this information may be used to derive a parking profile of an individual parking patron who repeatedly visits the parking structure. This parking profile may assist the emissions reduction service 100 in delivering highly accurate recommendations to frequent patrons, which will reduce emissions by improving the accuracy of recommendations overall, even to new/unknown patrons. Process flows for certain techniques for adjusting parameter values are described with respect to FIG. 3.

Emissions reduction service 100 may communicate with various system components in some cases using an application programming interface (API) exposed by, for example, a data store (105, 115), vehicle identification device or system (110, 151, 153), notification interface 120, CCTV and associated software components 152, or mobile app 154. An API is generally a set of programming instructions and standards for enabling two or more applications to communicate with each other. An API is an interface implemented by a program code component or hardware component (hereinafter "API-implementing component") that allows a different program code component or hardware component (hereinafter "API-calling component") to access and use one or more functions, methods, procedures, data structures, classes, and/or other services provided by the API-implementing component. An API can define one or more parameters that are passed between the API-calling component and the API-implementing component. The API and related components may be stored in one or more computer readable storage media. An API is commonly implemented as a set of Hypertext Transfer Protocol (HTTP) request messages and a specified format or structure for response messages according to a REST (Representational state transfer) or SOAP (Simple Object Access Protocol) architecture.

Figure 2A:
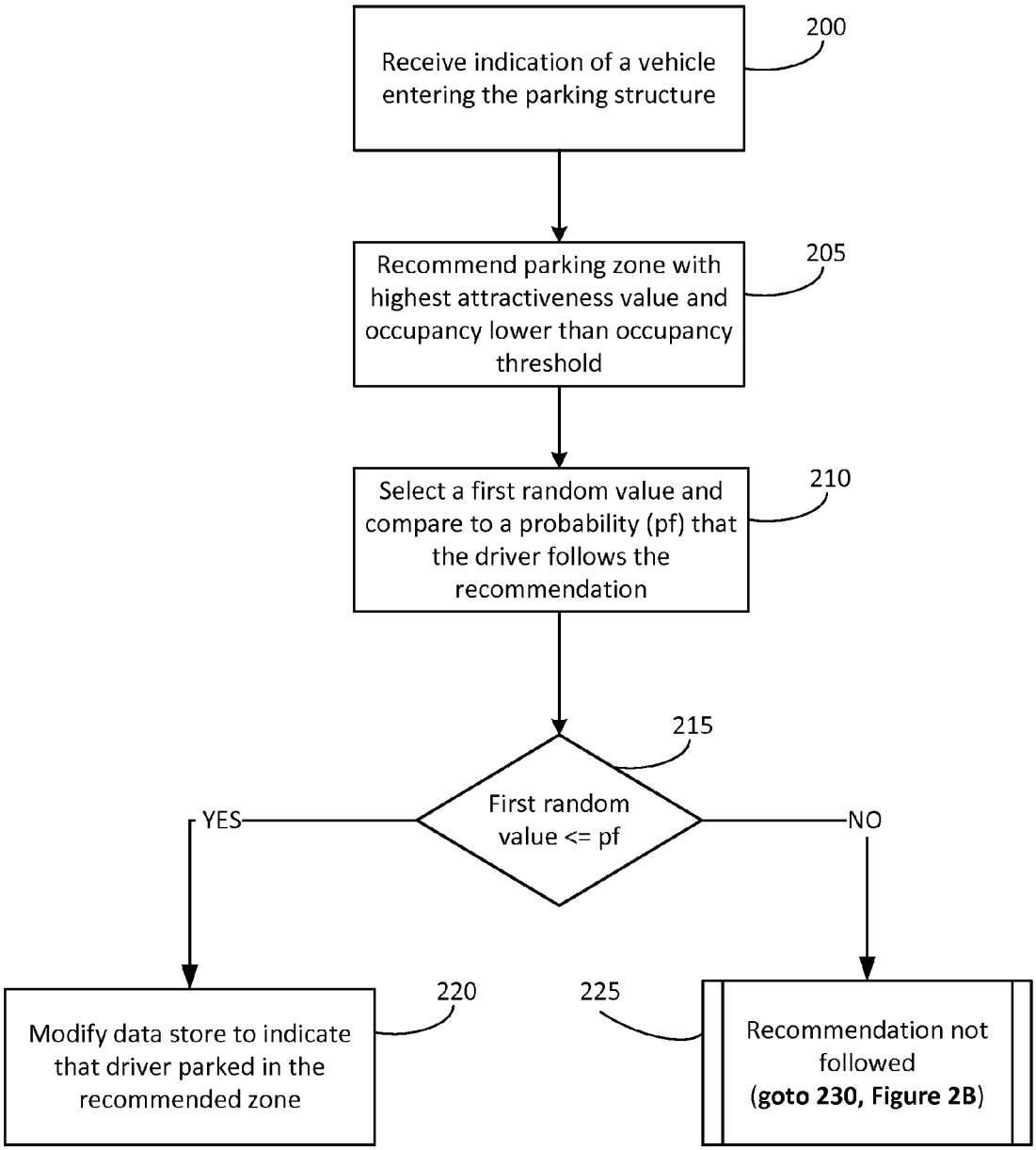
FIGS. 2A-2C show example process flows for reducing vehicle emissions by improving parking recommendations.
Figure 2B:
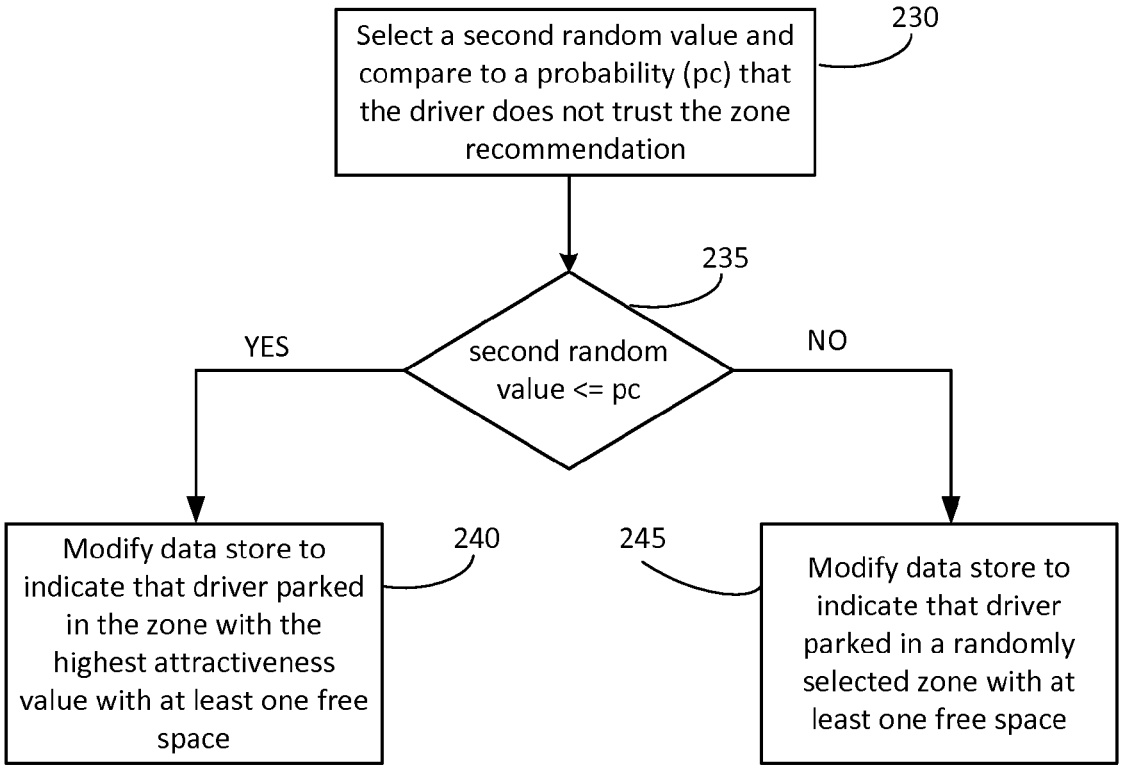
Figure 2C:
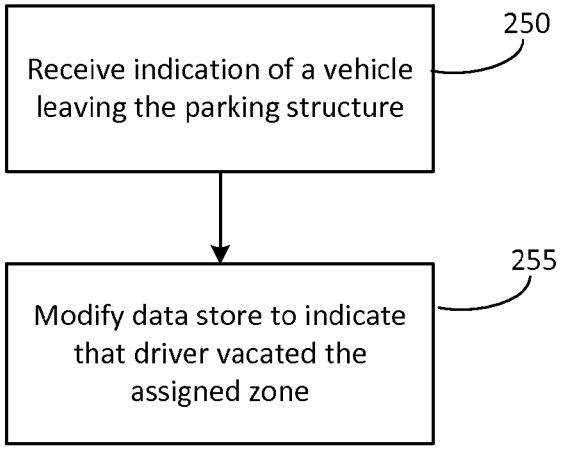

FIGS. 2A-2C show example process flows for reducing vehicle emissions by improving parking recommendations. The process flows in FIGS. 2A-2C may be implemented, for example, by an emissions reduction service 100 as described in FIG. 1.

FIG. 2A shows an example process flow for recommending an appropriate parking zone to a driver who enters the parking structure, determining the likelihood the driver followed the recommendation, and recording the updated occupancy information. Part of the process flow in Figure continues in FIG. 2B.

Beginning with FIG. 2A, an emissions reduction service 100 may receive an indication of a vehicle entering the parking structure (200). In many cases this indication would be received via an event message or other input from a vehicle identification device 110 stationed at one of the parking structure's entry lanes. As part of the event message, the vehicle identification device 110 (or system) communicates a vehicle identifier that uniquely identifies the vehicle with an acceptable level of certainty.

A recommended parking zone within the parking structure may then be determined by locating the zone with the highest attractiveness value that has an acceptable quantity of unoccupied spaces (205). A zone may be assigned an occupancy threshold (e.g. 90%) that denotes the maximum allowable occupancy ratio at which the system will consider the zone in making a recommendation. The occupancy ratio can be the ratio of believed occupied spaces to total spaces in the zone, or the ratio of believed unoccupied spaces to total spaces in the zone. The occupancy threshold for a parking zone can be a configurable value, and the occupancy threshold may apply to all zones equally or be set individually depending on implementation.

Once determined, the recommendation may be communicated via a notification interface 120 to the driver (e.g., a dynamic message sign visible from the entry lane, a mobile device application). The more accurately and reliably the recommendation is targeted toward a particular driver, the more likely the system will achieve advantages with respect to emission reduction.

Attractiveness values for parking zones in the structure may be derived in several ways, depending on the implementation, and may be refined by other components or systems that are available in some implementations. The attractiveness values for parking zones may be applicable to all drivers, tailored to groups or classifications of drivers, or tailored to individual drivers, depending on the implementation.

In some implementations, default attractiveness values may be set for parking zones as a system startup or configuration activity. In some cases, the parking structure may be subdivided (or existing subdivisions may be reconfigured) into parking zones as a configuration activity. As an example in a multi-story parking structure, the floors may be assigned a zone number (e.g., 1, 2, 3, 4, etc.). Each floor zone may be further subdivided into logical quadrants (e.g., A, B, C, D). Parking zone labels and/or signs may be posted for drivers to see. Each parking zone, e.g., 1A, 1B, . . . 3C, . . . 4D is then assigned an attractiveness value which allows the zones to be ranked by order of attractiveness, e.g., c(1A)>c(1B)> . . . >c(4A)>c(3D).

In some implementations, the attractiveness value for a zone can be arithmetically derived, for example by computing the distance of a parking zone from vehicular entrances and exits, pedestrian exits, and parking structure staircases or elevators. Naturally, several weighted factors may be combined to derive the attractiveness value. For example, the proximity of a pedestrian exit to the entrance of a nearby building might determine the weight given to that pedestrian exit's distance in the overall attractiveness calculation for the zone. In some implementations, attractiveness values may be determined by interviewing, polling, or conducting a survey of experts or frequent drivers/patrons of the parking structure.

In cases where additional driver information/metadata is available to the emissions reduction service 100, for example from a driver metadata store 115, it may be possible to determine specific attractiveness values for individuals, or for groups or classifications of drivers. For example, if a driver's metadata reveals that the driver is a member of a privilege class that restricts the driver from parking in some zones, then the corresponding attractiveness value for the restricted zones would equal zero. Likewise, if the privilege class entitles the driver to park in certain more desirable zones, then the attractiveness values for those desirable zones might be elevated as to that privilege class. For example, a professor at a university has an ORANGE decal, which entitles her to park in ORANGE and GREEN zones, but not BLUE. Thus, the order of attractiveness for ORANGE decals might be c(ORANGE)>c(GREEN)>c(BLUE)=0.

Other aspects of a driver's metadata, such as the driver's department in a nearby company, might be a factor in classification or grouping. For example, it might be determinable that an employee of the marketing department prefers the south side of the parking structure because of the proximity of a pedestrian exit near an office building entrance close to the marketing department. Thus, marketing department employees might prefer a 4SOUTH zone to a 3WEST zone, even though reaching 4SOUTH requires driving up to a higher level to park.

In some implementations, individualized attractiveness values can be assigned to recurrent driver/patrons. In some cases, attractiveness values may be set in accordance with default values (i.e., for all drivers or for groups/classifications) that are further tuned over time to become personalized. A divergence between the recommended parking zone and the actual parking zone can indicate that the emissions reduction service 100 made an inadequate recommendation; improving the recommendation may result in improved emissions reduction. As noted with respect to FIG. 1, emissions reduction service 100 may interface with various system components such as roving vehicle identification devices 151, CCTV 152, vehicle identification devices on zones 153, and mobile device applications 154, and to discover divergences between the recommendation and the actual parking zone for a driver. By analyzing a historical record of divergences between recommended and actual zone, the emissions reduction service 100 can adjust the attractiveness value assigned to various zones on an individual or group basis.

In some implementations, drivers may self-tune their individualized attractiveness values, for example by using an electronic system to rank or adjust the attractiveness of parking zones.

Returning to FIG. 2A, having made and communicated a recommendation to the driver, the emissions reduction service 100 assesses whether the driver followed the recommendation so that occupancy statistics may be updated. This assessment involves determining whether the recommendation was followed and, if the recommendation was not followed, whether the driver diverged from the recommendation while adhering to the existing order of attractiveness or to an unknown order of attractiveness.

A first random value is selected to represent the driver's action in response to the recommendation. The first random value may be selected from a normalized uniform distribution, using a standard algorithm. The randomly selected value is compared to a probability value (pf) that denotes the probability that a driver follows the system's recommendation (210).

The probability value pf is representative of the likelihood a driver will follow the system's recommendation; pf may be initially configured with a default value (e.g., 80% or 0.8) and tuned over time with real historical data at a given parking structure. Thus (similarly to the attractiveness value), by analyzing a historical record of divergences between the recommended and actual zone, the emissions reduction service 100 can adjust pf to improve its accuracy over time. In some cases, pf may be applicable to all parking patrons. In some implementations, pf may be assigned by sub-category (or group or classification) of patron; for example, historical data may reveal that first-time users of the parking structure have a lower likelihood (e.g., 0.5) of following the recommendation than repeated users (e.g., 0.8) who have come to trust the system's recommendations.

The first random value is tested against pf (215), and if the first random value is within the probability range (<=pf), the emissions reduction service 100 assumes that the driver followed the recommendation (YES path to 220). The data store 105 is modified to indicate that the driver parked in the recommended zone (220). The modification to the data store may include associating the recommended parking zone with the vehicle's entry record, for example by updating a database table containing the identifiers of currently parked vehicles and their recommended and assigned parking zone locations. Another modification may include increasing a counter of the number of occupied spaces in a parking zone.

If the first random value is not within the probability range (>pf), then the emissions reduction service 100 assumes that the driver did not follow the recommendation (NO path to 225), which initiates the sub-process flow in FIG. 2B, beginning at step 230. Note that, if the driver does not receive the recommendation because a notification interface is unavailable (e.g., the dynamic sign is non-functional or not present at the entrance the driver used, and a mobile device application is unavailable), no recommendation was given, and hence processing can proceed directly to FIG. 2B, step 230.

Turning now to FIG. 2B, the emissions reduction service 100 assesses whether the driver chose the first available parking space in what the service determines is the most attractive zone, or whether the driver acted in accordance with an indeterminate order of attractiveness.

A second random value is selected to represent the driver's action in finding a parking space. The second random value may be selected from a normalized uniform distribution, using a standard algorithm. The randomly selected value is compared to a probability value (pc) that denotes the probability that a driver does not trust the zone recommendation (230).

The probability value pc is representative of the likelihood a driver will follow the system's understanding of what constitutes an attractive parking zone. As noted, attractiveness values (and thus order of attractiveness) may vary by group or even by user in some implementations. The probability value pc therefore represents a likelihood that the driver and the system are in agreement about the order of attractiveness of the parking zones in the parking structure.

The probability value pc may be initially configured with a default value (e.g., 80% or 0.8) and tuned over time with real historical data at a given parking structure. Thus (similarly to the attractiveness value and the probability value pf), by analyzing a historical record of divergences between the recommended and actual zone, and whether the actual zone reflects the most attractive zone available at the time chosen, the emissions reduction service 100 can adjust pc to improve its accuracy over time.

In some cases, a pc value may be applicable to all parking patrons. In some implementations, pc may assigned by sub-category (or group or classification) of patron; for example, historical data may reveal that first-time patrons of the parking structure have a lower likelihood (e.g., 0.5) of selecting a space based on the system's order of attractiveness than repeated users (e.g., 0.8) because the first-time parking patrons have less understanding of what constitutes an attractive parking zone in the unknown structure.

The second random value is tested against pc (235), and if the second random value is within the probability range (<=pc), the emissions reduction service assumes 100 that the driver and the system agree on what constitutes the most attractive parking zone (YES path to 240). The data store 105 is modified to indicate that the driver parked in the zone with the highest attractiveness value having at least one free space (240). The modification to the data store may include associating the assigned parking zone with the vehicle's entry record, for example by updating a database table containing the identifiers of currently parked vehicles and their recommended and assigned parking zone locations. Another modification may include increasing a counter of the number of occupied spaces in a parking zone.

If the second random value is not within the probability range (>pc), then the emissions reduction service 100 assumes that the driver acts according to an order of attractiveness that the system does not understand (NO path to 245). In other words, the driver is assumed to be acting inscrutably to the system. Therefore, the emissions reduction service 100 modifies the data store 105 to assign the vehicle to a randomly selected parking zone having at least one free space (245).

FIG. 2C shows an example process flow operative when a vehicle leaves the parking structure. In FIG. 2C, an emissions reduction service 100 may receive an indication of a vehicle leaving the parking structure (250). In many cases this indication would be received via a notification message or other input from a vehicle identification device 110 stationed at one of the parking structure's exit lanes. As part of the notification, the vehicle identification device 110 (or system) communicates a vehicle identifier that uniquely identifies the vehicle with an acceptable level of certainty.

The data store is modified to indicate that the driver vacated the parking zone the driver was assigned or recommended (255). The modification to the data store 105 may include removing the association between the assigned parking zone and the vehicle's entry record, for example by updating a database table containing the identifiers of currently parked vehicles and their current parking zone locations. Another modification may include decreasing a counter of the number of occupied spaces in the assigned parking zone. In some implementations, the data store may be modified to maintain a historical record of parking zone assignments to assist in tuning the accuracy of certain system and individualized parameters such as pf, pc, and attractiveness values.

Figure 3:
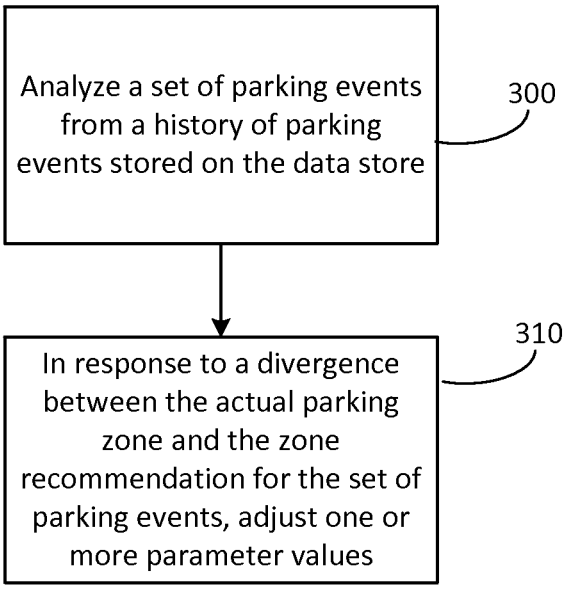
FIG. 3 shows an example process flow for updating parameter values in response to historical parking events.

FIG. 3 shows an example process flow for updating parameter values in response to historical parking events. Techniques in the example process flow may be performed in some implementations by an emissions reduction service 100, as described in FIG. 1. Techniques are operative in component environments having one or more parking survey devices (e.g., 151, 152, 153, and 154 from FIG. 1) which can provide updated feedback about whether a particular vehicle followed the system recommendation for a parking zone (i.e., zone recommendation) by recording the post-recommendation behavior of the particular vehicle.

In FIG. 3, a set of parking events from a history of parking events stored on the data store may be analyzed (300). In some cases, a level of divergence between the actual parking zone and the zone recommendation for a plurality of parking events may be determined. The level of divergence may be determined by analyzing a historical record of parking recommendations and post-recommendation behaviors that are stored in the data store. In some implementations, the historical record may be stored as, e.g., logs or database records including a vehicle identifier, the system recommendation ("zone recommendation") and the actual parking zone. Each instance of parking by a particular vehicle can be termed a "parking event," and each entry in the historical record (e.g., log or database record) describes a single parking event. The historical record may be stored for a fixed time (e.g., weeks, months, years), in a fixed quantity, or perpetually.

The level of divergence between the actual parking zone and the zone recommendation indicates the degree to which a driver, subset of drivers, or all drivers who patronize a parking structure are likely to follow the recommendations of the system. The level of divergence may be derived, for example, by calculating the percentage of parking events in which the zone recommendation matches the actual parking zone. In this example, the level of divergence is similar to a historically-based version of the probability value pf, calculated over a time range or set of parking events.

The level of divergence may be calculated over all of, or any subset of, recorded parking events. For example, the level of divergence may be calculated over a set of parking events occurring over a time range (e.g., the last month). In some cases, the level of divergence may be calculated over a set of parking events that includes only a particular vehicle identifier. In some cases, the level of divergence may be calculated over a set of parking events that includes a group or classification of vehicles, such as the members of a department, employees of a certain company, or the holders of a particular kind of parking permit.

An adjustment may be made to one or more parameter values when the system determines that the historical level of divergence does not match system assumptions about the behavior of drivers (310). Parameter values can include, for example, pf, pc, and/or the attractiveness value for a parking zone, applied at any level at which those parameters are implemented (e.g., system-wide, to individual vehicle identifiers, and to subsets of vehicle identifiers). Naturally, other parameter values applicable system-wide or to subsets of vehicle identifiers can be modified.

In some cases, for example, when the historical level of divergence is significantly different from pf (determined, for example, by the difference exceeding a threshold setting of 10%), the pf probability value may be adjusted. In some cases this may mean system-wide adjustment of the pf value, and in others pf values for individual vehicles or subsets of vehicles may be adjusted.

In some cases, historical data about parking events may indicate that the probability value pc (indicating the likelihood the system has applied an accurate order of attractiveness for the available parking zones to the particular vehicle), or the attractiveness value for one or more parking zones, can be modified system-wide or for a subset of vehicle identifiers. For example, analysis of a set of parking events related to Company A may indicate that, not only do employees of Company A generally ignore the recommended zone, they also overwhelmingly choose to park on level 2, rather than level 1, as recommended. The attractiveness values for levels 1 and 2 might therefore be adjusted (e.g., modified so as to reverse their order of attractiveness) for the Company A group, or for the individual vehicle identifiers related to employees of Company A. Future recommendations to employees of Company A may then favor level 2 and the overall accuracy of system recommendations may improve.

Figure 4:
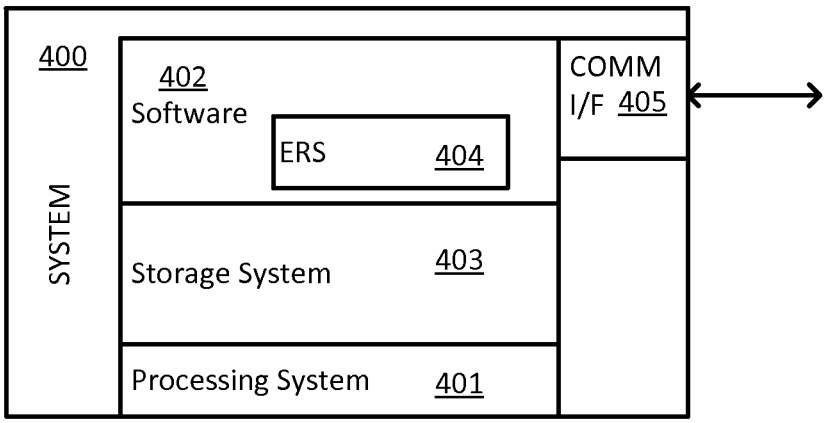
FIG. 4 shows a block diagram illustrating components of a computing device or system used in some implementations.

FIG. 4 shows a block diagram illustrating components of a computing device or system used in some implementations of the described emissions reduction service, associated service data store, notification interface, or mobile app. For example, any computing device operative to run an emissions reduction service 100 or intermediate devices facilitating interaction between other devices in the environment may each be implemented as described with respect to system 400, which can itself include one or more computing devices. The system 400 can include one or more blade server devices, standalone server devices, personal computers, routers, hubs, switches, bridges, firewall devices, intrusion detection devices, mainframe computers, network-attached storage devices, and other types of computing devices. The hardware can be configured according to any suitable computer architectures such as a Symmetric Multi-Processing (SMP) architecture or a Non-Uniform Memory Access (NUMA) architecture.

The system 400 can include a processing system 401, which may include a processing device such as a central processing unit (CPU) or microprocessor and other circuitry that retrieves and executes software 402 from storage system 403. Processing system 401 may be implemented within a single processing device but may also be distributed across multiple processing devices or sub-systems that cooperate in executing program instructions.

Examples of processing system 401 include general purpose central processing units, application specific processors, and logic devices, as well as any other type of processing device, combinations, or variations thereof. The one or more processing devices may include multiprocessors or multi-core processors and may operate according to one or more suitable instruction sets including, but not limited to, a Reduced Instruction Set Computing (RISC) instruction set, a Complex Instruction Set Computing (CISC) instruction set, or a combination thereof. In certain embodiments, one or more digital signal processors (DSPs) may be included as part of the computer hardware of the system in place of or in addition to a general purpose CPU.

Storage system 403 may comprise any computer readable storage media readable by processing system 401 and capable of storing software 402 including, e.g., emissions reduction service 100, service data store 105, instructions for a notification interface 120, and mobile app 154. Storage system 403 may include volatile and nonvolatile, removable and non-removable media implemented in any method or technology for storage of information, such as computer readable instructions, data structures, program modules, or other data.

Examples of storage media include random access memory (RAM), read only memory (ROM), magnetic disks, optical disks, CDs, DVDs, flash memory, solid state memory, phase change memory, or any other suitable storage media. Certain implementations may involve either or both virtual memory and non-virtual memory. In no case do storage media consist of a propagated signal. In addition to storage media, in some implementations, storage system 403 may also include communication media over which software 402 may be communicated internally or externally.

Storage system 403 may be implemented as a single storage device but may also be implemented across multiple storage devices or sub-systems co-located or distributed relative to each other. Storage system 403 may include additional elements, such as a controller, capable of communicating with processing system 401.

Software 402 may be implemented in program instructions and, among other functions, may, when executed by system 400 in general or processing system 401 in particular, direct system 400 or processing system 401 to operate as described herein for enabling emissions reduction through parking recommendations. Software 402 may provide program instructions 404 that implement an emissions reduction service 100, service data store 105, notification interface 120, or mobile app 154. Software 402 may implement on system 400 components, programs, agents, or layers that implement in machine-readable processing instructions the methods described herein as performed by emissions reduction service 100 (as instructions 404).

Software 402 may also include additional processes, programs, or components, such as operating system software, other application software, and software for interfacing with vehicle detection devices (110, 151, 153), CCTV systems 152, a vehicle metadata store 115, or mobile apps 154 developed by third parties. Software 402 may also include firmware or some other form of machine-readable processing instructions executable by processing system 401.

In general, software 402 may, when loaded into processing system 401 and executed, transform system 400 overall from a general-purpose computing system into a special-purpose computing system customized to facilitate emissions reduction through parking recommendations. Indeed, encoding software 402 on storage system 403 may transform the physical structure of storage system 403. The specific transformation of the physical structure may depend on various factors in different implementations of this description. Examples of such factors may include, but are not limited to, the technology used to implement the storage media of storage system 403 and whether the computer-storage media are characterized as primary or secondary storage.

System 400 may represent any computing system on which software 402 may be staged and from where software 402 may be distributed, transported, downloaded, or otherwise provided to yet another computing system for deployment and execution, or yet additional distribution.

In embodiments where the system 400 includes multiple computing devices, one or more communications networks may be used to facilitate communication among the computing devices. For example, the one or more communications networks can include a local, wide area, or ad hoc network that facilitates communication among the computing devices. One or more direct communication links can be included between the computing devices. In addition, in some cases, the computing devices can be installed at geographically distributed locations. In other cases, the multiple computing devices can be installed at a single geographic location, such as a server farm or an office.

A communication interface 405 may be included, providing communication connections and devices that allow for communication between system 400 and other computing systems (not shown) over a communication network or collection of networks (not shown) or the air. Examples of connections and devices that together allow for inter-system communication may include network interface cards, antennas, power amplifiers, RF circuitry, transceivers, and other communication circuitry. The connections and devices may communicate over communication media to exchange communications with other computing systems or networks of systems, such as metal, glass, air, or any other suitable communication media. The aforementioned communication media, network, connections, and devices are well known and need not be discussed at length here.

It should be noted that many elements of system 400 may be included in a system-on-a-chip (SoC) device. These elements may include, but are not limited to, the processing system 401, a communications interface 405, and even elements of the storage system 403 and software 402.

Alternatively, or in addition, the functionality, methods and processes described herein can be implemented, at least in part, by one or more hardware modules (or logic components). For example, the hardware modules can include, but are not limited to, application-specific integrated circuit (ASIC) chips, field programmable gate arrays (FPGAs), system-on-a-chip (SoC) systems, complex programmable logic devices (CPLDs) and other programmable logic devices now known or later developed. When the hardware modules are activated, the hardware modules perform the functionality, methods and processes included within the hardware modules.

It should be understood that the examples and embodiments described herein are for illustrative purposes only and that various modifications or changes in light thereof will be suggested to persons skilled in the art and are to be included within the spirit and purview of this application.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

What is claimed is:

1. A system for reducing vehicle emissions in a parking structure, the system comprising:

one or more non-transitory computer readable storage media;

a processing system;

one or more vehicle identification devices operative to identify a vehicle entering and leaving the parking structure;

a data store contained on the one or more non-transitory computer readable storage media comprising:

one or more attractiveness values assigned to zones in the parking structure, each zone representing a plurality of parking spaces within the parking structure;

a first probability value (pf) denoting a probability of a driver following a recommendation;

a second probability value (pc) denoting a probability of the driver not trusting the recommendation;

program instructions for an emissions reduction service stored on the one or more non-transitory computer readable storage media that direct the processing system to:

in response to receiving, from the one or more vehicle identification devices, an indication of a particular vehicle entering the parking structure:

determine a zone recommendation by selecting a particular zone, of the zones in the parking structure having the highest attractiveness value with an occupancy ratio lower than an occupancy threshold;

when a notification interface is available to a driver of the particular vehicle, render the zone recommendation on the notification interface, select a first random value and, when the first random value is lesser than or equal to pf, modify the data store to indicate that an assigned zone of the particular vehicle is the zone recommendation;

when the notification interface is not available to the driver of the particular vehicle, or when the first random value is higher than pf, select a second random value and, when the second random value is less than or equal to pc, modify the data store to indicate that the assigned zone of the particular vehicle is the zone having the highest attractiveness value, having at least one available space, and when the second random value is greater than pc, modify the data store to indicate that the assigned zone of the particular vehicle is a zone randomly selected from one or more zones, of the zones in the parking structure, having at least one available space; and in response to receiving, from one of the one or more vehicle identification devices, an indication of the particular vehicle leaving the parking structure, modify the data store to indicate that the particular vehicle vacated the assigned zone;

a plurality of parking survey devices, the parking survey devices identifying, from the zones in the parking structure, an actual parking zone of the particular vehicle, and the parking survey devices comprising one or more roving vehicle identification devices, one or more vehicle zone identification devices associated with a zone of the zones in the parking structure, one or more CCTV systems, one or more mobile devices executing one or more applications, or a combination thereof;

program instructions, that, in response to receiving from the parking survey devices an indication of the actual parking zone of the particular vehicle, modify the data store to store the actual parking zone of the particular vehicle; and program instructions to:

analyze a set of parking events from a history of parking events stored on the data store; and in response to a divergence between the actual parking zone and the zone recommendation for the set of parking events, adjust parameter values, the parameter values comprising the first probability value (pf), the second probability value (pc), and the attractiveness value of the actual parking zone.

2. The system of claim 1, wherein the set of parking events is restricted to the parking events of a single vehicle identifier.

3. The system of claim 1, wherein the set of parking events is restricted to the parking events of a subset of vehicle identifiers.

4. The system of claim 1, further comprising a vehicle metadata store.

5. The system of claim 4, wherein the program instructions to determine the zone recommendation comprise instructions that direct the processing system to:

obtain a vehicle classification for the particular vehicle from the vehicle metadata store; and select the particular zone from a set of parking zones determined by the vehicle classification.

6. The system of claim 4, wherein the program instructions to determine the zone recommendation comprise instructions that direct the processing system to:

obtain a vehicle metadata for the particular vehicle from the vehicle metadata store; and select, from the data store, a subset of the one or more attractiveness values assigned to one or more zones in the parking structure, wherein the subset is determined by the vehicle metadata.

7. The system of claim 1, wherein the one or more vehicle identification devices comprise one or more license plate readers, one or more parking permit readers, one or more closed-circuit television systems, or a combination thereof.

8. The system of claim 1, wherein the notification interface is one or more of a dynamic sign and a mobile device application.

9. A method for improving parking recommendations in a parking structure, the method comprising:

in response to receiving, by one or more processors, from a vehicle identification device, an indication of a particular vehicle entering the parking structure:

determining a zone recommendation by the one or more processors, from zones in the parking structure, each zone representing a plurality of parking spaces within the parking structure and each zone having an attractiveness value, by selecting a particular zone having the highest attractiveness value and an occupancy ratio lower than an occupancy threshold;

when a notification interface is available to a driver of the particular vehicle, rendering the zone recommendation on the notification interface, selecting, by the one or more processors, a first random value and, when the first random value is lesser than or equal to a probability (pf) of the driver following the recommendation, modifying, by the one or more processors, a data store to indicate that an assigned zone of the particular vehicle is the zone recommendation;

when the notification interface is not available to the driver of the particular vehicle, or when the first random value is higher than pf, selecting, by the one or more processors, a second random value and, when the second random value is less than or equal to a probability (pc) that the driver does not trust the zone recommendation, modifying, by the one or more processors, the data store to indicate that the assigned zone of the particular vehicle is the zone having the highest attractiveness value, having at least one available space, and when the second random value is greater than pc, modifying, by the one or more processors, the data store to indicate that the assigned zone of the particular vehicle is a zone randomly selected from one or more zones, of the zones in the parking structure, having at least one available space; and in response to receiving, by the one or more processors, from the vehicle identification device, an indication of the particular vehicle leaving the parking structure, modify the data store to indicate that the particular vehicle vacated the assigned zone;

receiving, by the one or more processors, an indication of an actual parking zone, of the zones in the parking structure, of the particular vehicle from a plurality of parking survey devices; and modifying, by the one or more processors, the data store to store the actual parking zone of the particular vehicle;

analyzing, by the one or more processors, a set of parking events from a history of parking events stored on the data store; and in response to a divergence between the actual parking zone and the zone recommendation for the set of parking events, adjusting, by the one or more processors, parameter values, the parameter values comprising the first probability value (pf), the second probability value (pc), and the attractiveness value of the actual parking zone.

10. The method of claim 9, wherein determining the zone recommendation comprises:

obtaining a vehicle classification for the particular vehicle from a vehicle metadata store; and selecting the particular zone from a set of parking zones determined by the vehicle classification.

* * * * *